US007661557B2

(12) United States Patent
Volker et al.

(10) Patent No.: US 7,661,557 B2
(45) Date of Patent: Feb. 16, 2010

(54) METERING DEVICE FOR A MEDIUM

(75) Inventors: Goebel Volker, Constance (DE); Joachim Koerner, Uhldingen-Muehlhofen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 245 days.

(21) Appl. No.: 11/880,866

(22) Filed: Jul. 24, 2007

(65) Prior Publication Data

US 2008/0029539 A1 Feb. 7, 2008

(30) Foreign Application Priority Data

Aug. 1, 2006 (DE) ..... 10 2006 036 962

(51) Int. Cl.
*B67D 5/22* (2006.01)

(52) U.S. Cl. ..... 222/36; 222/38; 222/321.7; 222/641; 222/644; 128/200.23; 128/205.23

(58) Field of Classification Search ..... 222/36, 222/38, 30, 641, 644, 402.1, 325, 402.13, 222/23, 321.7, 321.9; 128/200.23, 205.23
See application file for complete search history.

(56) References Cited

U.S. PATENT DOCUMENTS 5,284,133 A * 2/1994 Burns et al. ..... 128/200.23
5,544,647 A * 8/1996 Jewett et al. ..... 128/200.23
6,029,659 A * 2/2000 O'Connor ..... 128/203.12
6,202,642 B1 * 3/2001 McKinnon et al. ..... 128/200.23
6,595,389 B2 * 7/2003 Fuchs ..... 222/38
7,347,200 B2 * 3/2008 Jones et al. ..... 128/200.23
2004/0255936 A1 12/2004 Urbanus
2005/0028815 A1 2/2005 Deaton et al.

FOREIGN PATENT DOCUMENTS

WO WO 91/06334 5/1991
WO WO 00/64517 11/2000

OTHER PUBLICATIONS

German Patent Office Search Report dated Mar. 7, 2007 (3 pages).

* cited by examiner

*Primary Examiner*—Frederick C. Nicolas
(74) *Attorney, Agent, or Firm*—Flynn, Thiel, Boutell & Tanis, P.C.

(57) ABSTRACT

A metering device with an applicator housing having an application orifice for medium discharge. A metering pump conveys medium from a medium store to the applicator. An electronic counting module having a stroke detection means operatively engageable with a relatively movable pump portion of the metering pump. A data processing processor evaluates signals from the stroke detection means, and an indicator unit indicates data produced by the data processing processor. A current source supplies the data processing processor with current. A module housing houses an electronic counting module. The external dimensions of the module housing are conformed to the internal dimensions of a reception space. The reception space is open on one side of the applicator housing, so that the module housing can be inserted completely into the reception space through the opening and be fastened therein.

14 Claims, 5 Drawing Sheets

METERING DEVICE FOR A MEDIUM

FIELD OF THE INVENTION

The invention relates to a metering device for a medium, with an applicator housing which has at, least one application orifice for the discharge of the medium, with a metering pump which conveys medium out of a medium store to the applicator, and with an electronic counting module which has at least one stroke detection means, assigned to a relatively movable pump portion of the metering pump, and a data processing processor which detects and evaluates signals from the stroke detection means, and also with an indicator unit which indicates data produced by the data processing processor, and with a current source which supplies the data processing processor with current.

BACKGROUND OF THE INVENTION

A metering device of this type is known from WO 00/64517. There, the electronic counting module is mounted on the outside on a housing of the metering device.

The object of the invention is to provide a metering device of the type mentioned in the introduction, which has an improved arrangement of the counting module.

This object is achieved in that the electronic counting module has a module housing, the external dimensions of which are adapted to internal dimensions of a reception space, open on at least one side, of the applicator housing, in such a way that the module housing can be inserted completely into the reception space and be fastened in the latter. This affords a complete integration of the electronic counting module into the metering device. The insertion and fastening of the module housing for the electronic counting module in the applicator housing makes it possible, on the one hand, to have a particularly protected accommodation of the counting module and, on the other hand, to have a visually pleasing integration of the counting module into the applicator housing. The reason for this is that, although the counting module has its own module housing, this module housing cannot be seen from outside, since it is integrated in the applicator housing. The modular nature of the counting module results not only in the protection function, but also in simple handling during assembly. The at least one stroke detection means is assigned to a relatively movable pump portion. This means that the stroke detection means and the pump portion are assigned to different components which are arranged movably in relation to one another, irrespective of whether the stroke detection means or the pump portion is moved. One of the two functional parts must in any event be virtually stationary in relation to the other, in order to make stroke detection possible.

The reception space and the counting module are preferably coordinated with one another in such a way that the counting module, which is inserted completely in the reception space, comes to bear with its outer faces in the reception space in such a way that there is no longer any remaining freedom of movement.

In a refinement of the invention, the fastening provided is toolless and releasable. This makes it possible to insert and remove the module housing in a particularly simple way. It is therefore also possible to insert the module housing, including the counting module, into the applicator housing only at a later stage. This is advantageous particularly when the metering device is made available in only premounted state to the user who has to assemble the various parts of the metering device so as to be ready for operation. Moreover, the refinement allows easy exchange or a simple separate disposal of the counting module or of its components.

In a further refinement of the invention, the module housing and the reception space have latching profilings matching with one another, in such a way that the module housing can be latched in the reception space. In this embodiment, advantageously, both the module housing and the applicator housing are produced from plastic. Latching may be releasable or unreleasable. Alternatively, the module housing and the reception space may be coordinated with one another in terms of their size in such a way that the module housing can be fastened nonpositively in the reception space. In this case, too, an embodiment consisting of plastic is preferred.

In a further refinement of the invention, the module housing has an inspection window, behind which the indicator unit is positioned. In a further refinement, the reception space has, spaced apart from a mounting or demounting orifice, an outwardly open clearance, in which the inspection window of the module housing is arranged when the module housing is in the mounted state. In this case, the clearance is coordinated in its dimensions with the inspection window in such a way that the inspection window of the module housing can be viewed at least essentially unrestrictedly from outside. In a preferred refinement, the inspection window is shouldered outward in the manner of a step, in such a way that its marginal edges form, together with corresponding margins of the clearance of the applicator housing, latching profilings which match with one another and which latch the module housing in the reception space. In a special development of the invention, the inspection window is a one-piece part of the module housing. This makes it possible for the module housing to have a particularly simple and cost-effective design.

It is particularly advantageous if the reception space into which the module housing is inserted has separately from one another a mounting and demounting orifice, on the one hand, and a clearance for the inspection window, on the other hand. The clearance may in such a case be designed to be smaller than the external dimensions of the module housing, so that a margin of the clearance or the wall itself surrounding the clearance cooperates as a holding portion in securing the module housing.

In a further refinement of the invention, the at least one stroke detection means is designed for digital or analog displacement detection. Digital displacement detection detects one or more instantaneous stroke points during the metering stroke. If the stroke points are detected at the start and end of a stroke operation, it can be ascertained whether a complete or only a partial stroke has taken place. Analog displacement detection detects a displacement distance which ensures additional evaluation possibilities, such as stroke speed, metering volume and the like.

In a further refinement of the invention, the data processing processor is arranged on a circuit board which is arranged in the module housing in such a way that it can execute deflecting movements in at least one direction. It is thereby possible to compensate tolerances in the production and mounting of the metering device. Moreover, the situation is prevented where the circuit board or the data processing processor may be damaged during a stroke operation.

In a further refinement of the invention, the indicator unit comprises a, liquid crystal display. As a result, corresponding information and data can be read off in a clearly visible way on the indicator unit.

In a further refinement of the invention, the module housing is of liquidtight or gastight design. The possibilities for using the metering device are thereby further improved. As a result, an insulation of the components within the module housing with respect to surrounding influences is achieved.

In a further refinement of the invention, the current source is designed as a battery or accumulator and is inserted in the manner of a sandwich between the liquid crystal display and the circuit board. This allows a particularly space-saving accommodation of the current source within the module housing. Moreover, the battery or accumulator forms a stable support for the external components, to be precise the liquid crystal display and the circuit board.

In a further refinement of the invention, the module housing has a closing cover which, in the mounted state, faces the stroke-movable pump portion. The closing cover allows the mounting of the components within the module housing and, depending on releasability, also renewed demounting.

In a further refinement of the invention, the closing cover is connected positively, nonpositively or materially integrally to a container-like housing portion. The module housing is preferably designed in two parts, in that, on the one hand, the container-like housing portion is provided and, on the other hand, the closing cover is provided, which is preferably latched, clamped, adhesively bonded or welded on the container-like housing portion.

In a further refinement of the invention, the closing cover comprises at least one touch-contact boss which is assigned to the stroke detection means and which is mounted movably between a switching position and a position of rest. The closing cover thereby assumes a multiple function, since, in addition to the closing function for the module housing, it also includes the actuation of the stroke detection means.

In a further refinement of the invention, the closing cover comprises a diaphragm face which is designed as a solid-state joint for the movability of the touch-contact boss. This refinement makes it possible for the closing cover to have a watertight configuration, since the closing cover can be designed to be continuously closed over its entire extent by virtue of the preferably elastically, movable diaphragm face.

In a further refinement of the invention, the diaphragm face is integrated in one piece into a dimensionally stable frame portion of the closing cover. The dimensionally stable frame portion assumes the carrying and closing function with regard to the module housing. The diaphragm face provides the movability of the touch-contact boss and at the same time ensures the leaktightness of the closing cover.

BRIEF DESCRIPTION OF THE DRAWINGS

Further advantages and features of the invention may be gathered from the claims and from the following description of preferred exemplary embodiments of the invention which are illustrated by means of the drawings in which:

DETAILED DESCRIPTION

Figure 1:
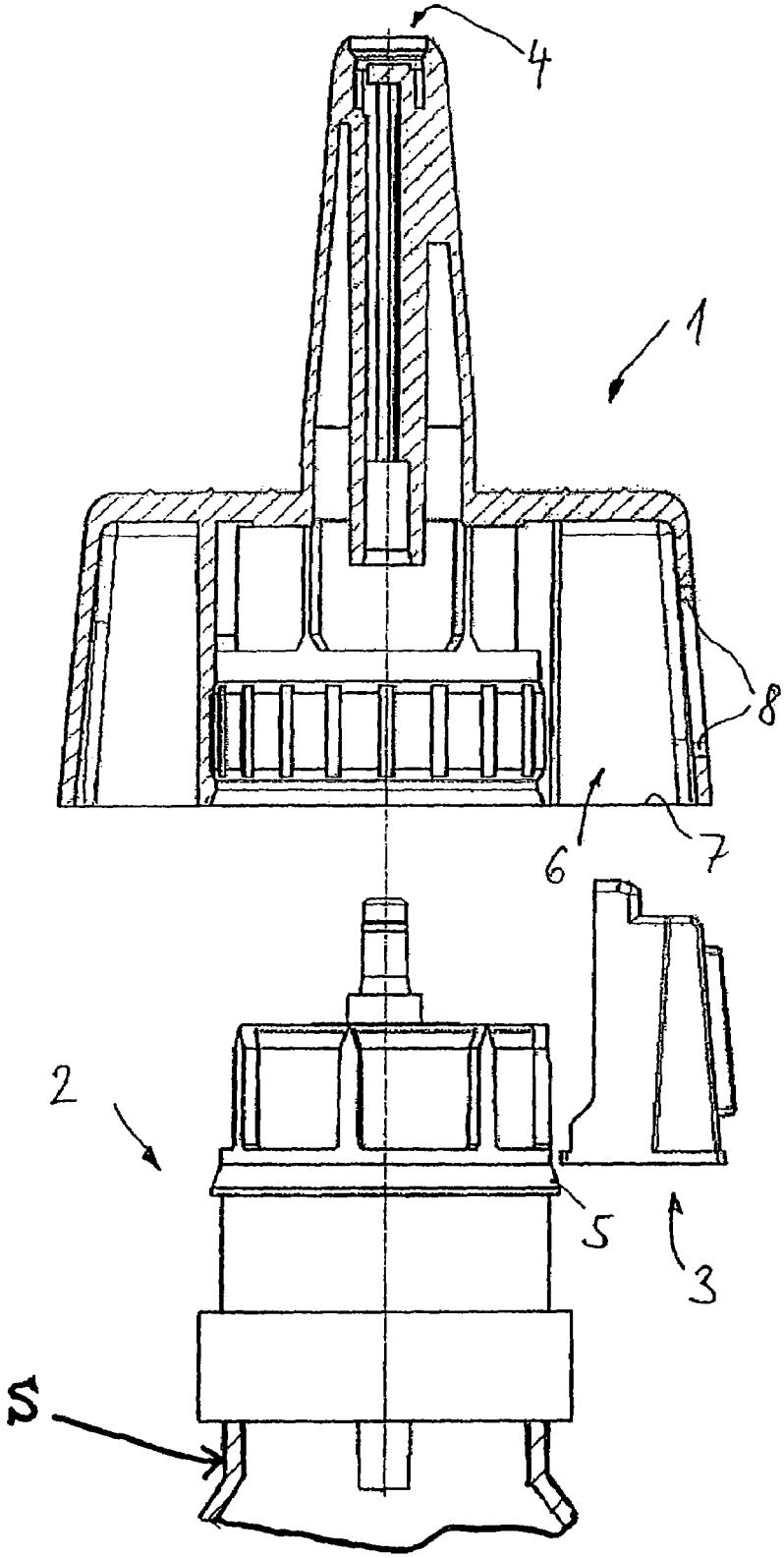
FIG. 1 shows a sectional illustration of an embodiment of a metering device according to the invention as an exploded illustration.

A metering device has, according to FIG. 1, an applicator housing 1 which is designed as a nose adapter, in order to apply an, in particular, liquid pharmaceutically active medium via the nose of an operator. The applicator housing 1 is produced from plastic and has an applicator tip, on the end face of which is provided an application orifice 4. A nozzle for atomizing the discharged liquid is not illustrated. The applicator housing 1 can be plugged onto a metering pump 2 which is supported in a housing, not illustrated in any more detail, of the metering device and which has a pump part 5 fixed to the housing. The applicator housing 1 is arranged so as to be axially movable in relation to the pump part 5 fixed to the housing. For this purpose, a tenon-like pump portion, onto which the applicator housing 1 is plugged, is arranged so as to be linearly movable in relation to the pump part 5. The pump part 5 has a radially outward-projecting switching handle which is configured in the manner of a peripheral shoulder. The peripheral shoulder cooperates with a touch-contact boss 19 of an electronic counting module, as is described in more detail below. It is essential that the switching handle of the pump part and the touch-contact boss of the counting module are arranged so as to be movable in relation to one another, irrespective of whether the counting module and consequently the applicator housing are assigned to a stationary or to a movable pump portion. If, according to an embodiment which is not illustrated, the applicator housing is assigned to a stationary pump portion, the switching handle which is to actuate the touch-contact boss is consequently assigned to a stroke-movable pump part. The metering pump 2 is connected in the basically known way not illustrated in any more detail here to a medium store S in which is contained the medium to be discharged.

So that an exact metering of, in particular, pharmaceutically highly active substances or media can be checked, the metering device is assigned an electronic counting module 3. According to FIG. 2, the counting module 3 has a module housing 9 in which various functional parts of the electronic counting module 3 are accommodated. The module housing 9, has a housing portion of container-like configuration which is open on one side. This open side is closed by means of a closing cover 10 which is described in more detail below. The closing cover 10 is part of the module housing 9. The module housing, including its functional parts, is inserted into the applicator housing 1 and is fastened in the latter. For this purpose, according to FIG. 1, the applicator housing 1 has a downwardly open reception space 6. The reception space 6 has, on the one hand, a downwardly open mounting orifice 7 and, on the other hand, a laterally outwardly open clearance 8 into which the module housing can be latched. The dimensions of the reception space 6 are coordinated with the external dimensions of the module housing and consequently of the counting module 3 such that the module housing can be inserted completely into the reception space 6 and therefore does not project beyond the lower edge of the applicator housing 1. The module housing, like the applicator housing 1, consists of plastic and has on the outside an inspection window 11 which is integrated in one piece in the module housing 9. The module housing 9 is designed to be transparent at least in the region of the inspection window 11, but preferably over its entire surface.

Figure 2:
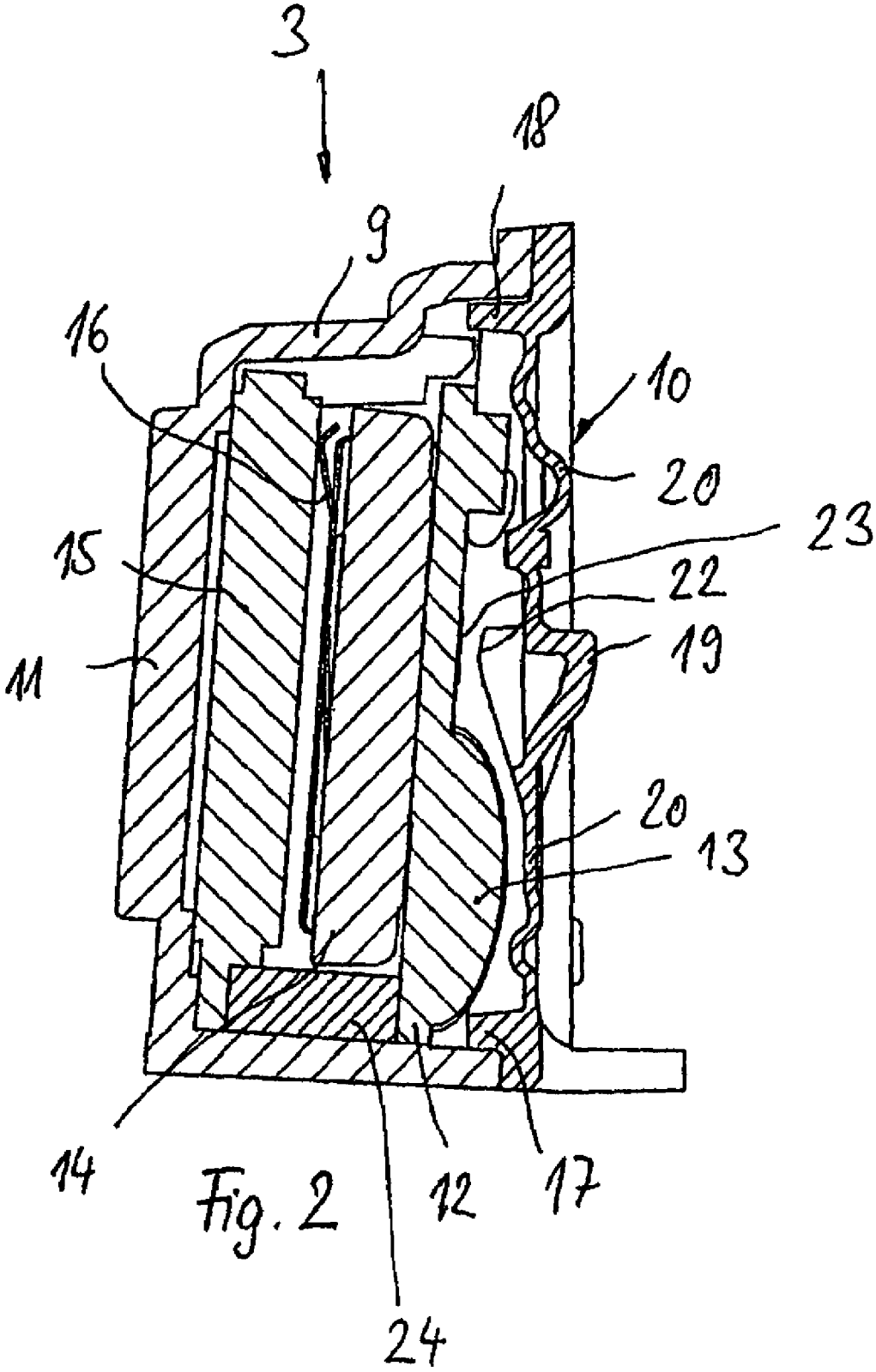
FIG. 2 shows a sectional illustration of an electronic counting module for the metering device according to FIG. 1.
Figure 3:
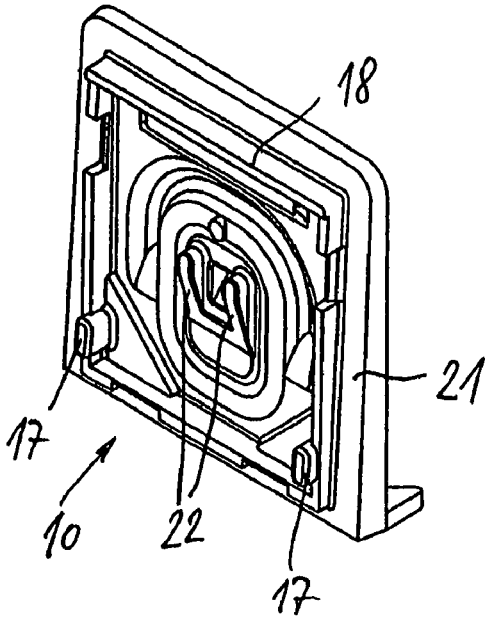
FIG. 3 shows a perspective illustration of a closing cover of a module housing of the electronic counting module according to FIG. 2.
Figure 4:
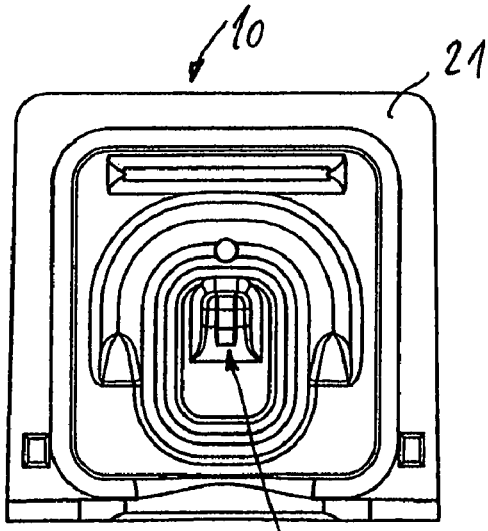
FIG. 4 shows the closing cover according to FIG. 3 in a front view.
Figure 5:
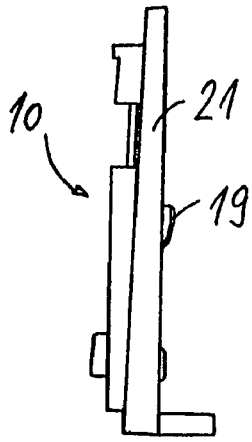
FIG. 5 shows the closing cover according to FIG. 4 in a side view.
Figure 6:
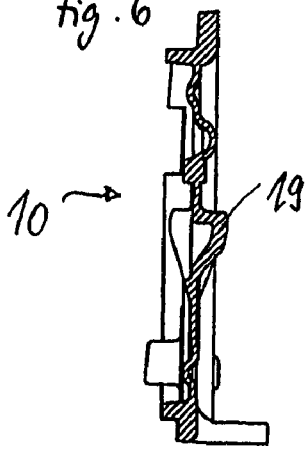
FIG. 6 shows the closing cover according to FIGS. 3 to 5 in a sectional illustration.

The inspection window 11 is formed by a step of thicker wall thickness, as can be seen from FIG. 2. The inspection window 11 may have visual features which can bring about a magnification or reduction of indicated data. The outer contour of the module housing 9 therefore has peripherally in the region of the inspection window 11 an outward step-like or socket-like projection. Corresponding edges of this projection and consequently of the inspection window 11 are designed as latching profilings which are coordinated with corresponding margins of the clearance 8 in such a way that the module housing, when inserted into the reception space 6, latches positively with its inspection window into the clearance 8. It is consequently possible to latch the module housing toollessly in the reception space 6, to be precise in the clearance 8 of the applicator housing 1, and, as required, also release it again from this latched position. The margins of the clearance 8 and the edges of the inspection window 11 or of the module housing 9 form latching profilings coordinated with one another and matching one another.

An indicator unit 15 in the form of a liquid crystal display is accommodated in the module housing 9 and is oriented on edge in the module housing 9 and parallel to the inspection window 11. The indicator unit 15 is directly adjacent to the inspection window 11, so that corresponding data and information on the indicator unit 15 can be detected from outside through the inspection window 11. The indicator unit 15 is conductively connected via a conductive rubber 24, also designated among experts as a; "zebra", to a circuit board 12 which is positioned parallel toward the distance from the indicator unit 15 so as to leave an interspace. A data processing processor 13, here in the form of a logic chip "ASIC", is attached to the circuit board 12. A current source. 14, here in the form of a parallelepipedal or cylinder-like battery, is arranged in the manner of a sandwich between the indicator unit 15 and the circuit board 12. The current source 14 is connected conductively to the circuit board 12, and, in the exemplary embodiment illustrated, it is fastened over its area to the latter. The circuit board 12 and the current source 14 are arranged so as to be movable to a limited extent in the direction of the indicator unit 15 and in the direction of the inspection window 11, in order to allow a deflection of the circuit board 12 and of the current source 14. So that the circuit board 12 and the battery 14 can be returned to the initial position spaced apart from the indicator unit 15, a restoring buffer 16, here in the form of a restoring spring designed as a leaf spring, is arranged between the battery 14 and the indicator unit 15.

The open side of the module housing 9 and consequently of the container-like housing portion is closed adjacently to the circuit board 12 and to the processor 13 by means of a closing cover 10 which is illustrated in more detail by means of FIGS. 3 to 6. The closing cover 10 is likewise produced from plastic and has a dimensionally stable peripheral frame 21 which is provided with fixing bosses 17 and with a fixing web 18, in order to allow positive insertion into the margin of the container-like housing portion of the module housing 9. In order to close the module housing 9 in a liquidtight or gastight manner, the closing cover 10 is connected with its peripheral frame 21 materially integrally to the peripheral margin of the container-like housing portion, preferably is peripherally welded or adhesively bonded to this margin. Moreover, the closing cover 10 has a touch-contact boss 19 shaped in one piece, which is peripherally connected in one piece via a closed diaphragm face 20 to the dimensionally stable frame 21 of the closing cover 10. The diaphragm face 20 is made flexible by a corresponding bead configuration formed by solid-state joints. The solid-state joints are designed in such a way that the touch-contact boss 19 is mounted movably in the direction of the circuit board 12. The solid-state joints which are formed by the diaphragm 20 are either designed in such a way that they bring about an elastic return of the touch-contact boss 19 out of an actuating position into the nonloaded initial position as soon as a corresponding actuating force is removed. Alternatively, in the region of the circuit board 12 or at another suitable location, an elastic restoring element is provided which moves the touch-contact boss 19 back into the nonloaded initial position. A corresponding elastic restoring element is illustrated in FIG. 2 as a simple spring clip which is not designated in any more detail.

On the rear side, facing the circuit board 12, of the diaphragm and of the closing cover 10, and consequently on the inside with respect to the touch-contact boss 19, a stirrup-like contacting element 22 is provided, which is designed as a conductive layer and is arranged in such a way that it serves as a bridging element for two electrical contact points 23 in the region of the circuit board 12.

In the exemplary embodiment illustrated, the thickness of the diaphragm amounts to about 0.3 mm. The diaphragm is preferably produced from a thermoplastic or elastomeric material. The rest of the closing cover 10 may also be produced from a thermoplastic or elastomeric material, the dimensional stability of the frame being achieved by a corresponding increase in the wall thickness. The use of thermoplastics is preferred to that of elastomers on account of the better weldability.

The touch-contact boss 19 lies in the path of movement of a switching handle of a stationary pump part 5 in such a way that the movement of the counting module 3, together with the applicator housing 1 and with the stroke-movable pump portion 5, necessarily leads to the situation where the touch-contact boss 19 runs in the manner of a wedge on the stationary pump part 5 during a corresponding stroke movement and is thereby pressed approximately radially outward with respect to the stroke axis of the metering pump 2. The contacting element 22 thereby acts as a bridge for the electrical contact faces 23 of the circuit board 12, with the result that a desired electrical switching operation is achieved.

Depending on the design of the data processing processor 13 with analog or digital signal recording of the movement of the touch-contact boss 19, either only a short switching operation of the touch-contact boss 19 or else the entire period of time in which the touch-contact boss 19 comes to bear before it returns into the initial position can be detected and be correspondingly evaluated. Preferably, the touch-contact boss 19 is coordinated with the switching handle of the stationary pump part in such a way that the touch-contact boss 19 remains in the actuated position during virtually the entire pump stroke. Alternatively, only short switching contact is achieved, which causes a corresponding counting operation for the corresponding pump stroke. The switching handle of the relatively movable pump part and the touch-contact boss 19 are coordinated with one another, depending on the changed path of movement of the touch-contact boss.

Depending on the design of the electronic data processing unit, a timer unit may also be integrated, which achieves improved evaluation possibilities, such as speed measurements or the like.

The embodiment of an electronic counting module according to FIGS. 2 to 6 has a watertight configuration.

Figure 7:
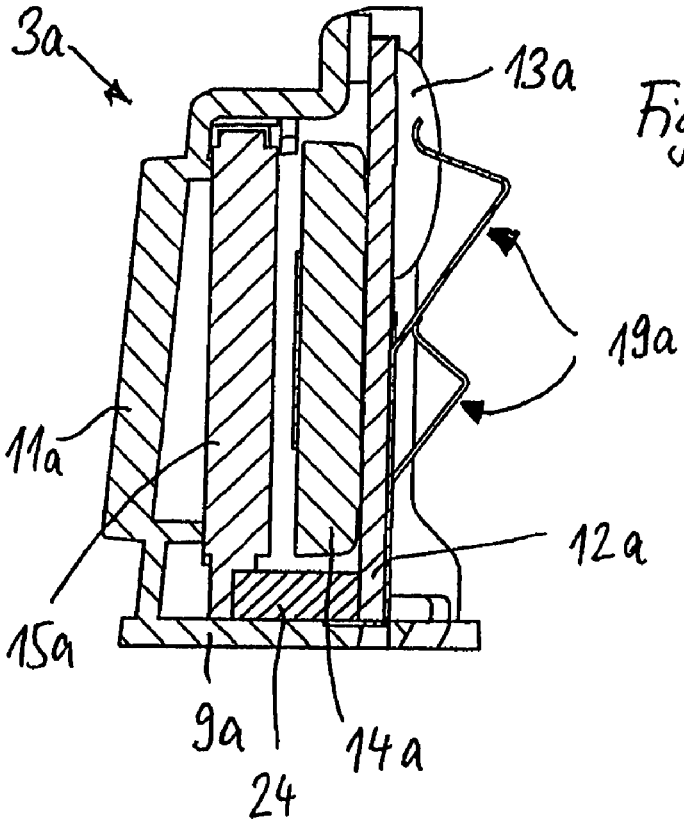
FIG. 7 shows an electronic counting module according to a further embodiment of a metering device.
Figure 8:
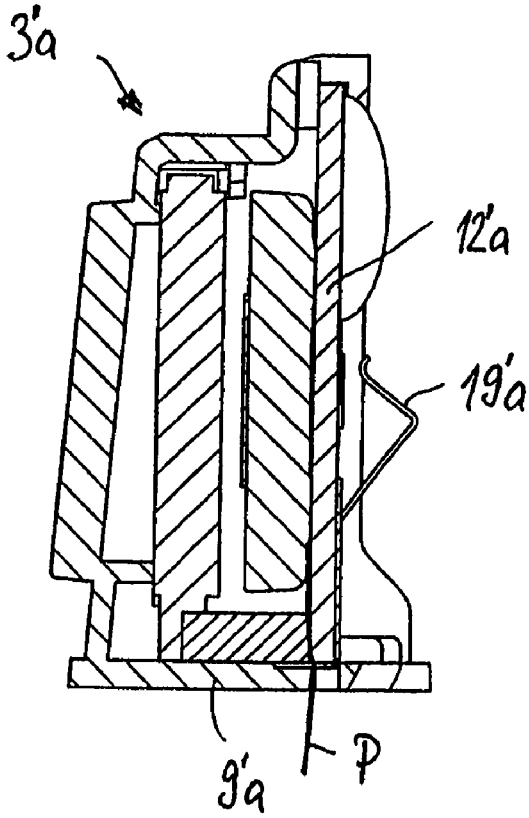
FIG. 8 shows an electronic counting module similar to FIG. 7.

In the embodiment according to FIGS. 7 and 8, the electronic counting modules 3*a* and 3'*a* respectively illustrated are not of watertight design. Both embodiments are identical in terms of basic construction to the embodiment according to FIG. 2. Only the differences are therefore dealt with below. Identical components are given the same reference symbols, with the letter "a" or "'a" being added. Statements regarding the counting module 3 according to FIG. 2 are also to apply in essential parts to the embodiment according to FIGS. 7 and 8.

The essential difference in the embodiments according to FIGS. 7 and 8 is that, there, the electronic counting modules 3*a* and 3'*a* have no separate closing cover. Instead, the respective circuit board 12*a* or 12'*a* forms with the corresponding data processing processor 13*a* the end-face closure of the module housing 9*a* or 9'*a*. Switching operations are caused by electrically conductive spring webs 19*a* and 19'*a*. In the embodiment according to FIG. 7, two spring webs spaced apart from one another are provided, which project inward to a differing extent radially with respect to the pump axis. Moreover, the spring webs are spaced apart from one another in the stroke direction. It is thereby possible to achieve two time-offset switching operations, so that a stroke movement triggers two different signals in the region of the stroke detection means which comprises the two spring webs.

In the embodiment according to FIG. 8, only a single spring web is provided, and therefore also only a single switching contact, which is designed in a similar way to the lower spring contact according to FIG. 7. Moreover, in the embodiment according to FIG. 8, a lug P is arranged between the circuit board 12'*a* and the current source, not designated in any more detail. The lug P projects downward out of the module housing 9'*a*. Pulling the lug downward serves for interrupting contact between the current source and the circuit board 12'*a*. A discharge of the current source, in particular of a battery, can thereby be prevented.

In both embodiments according to FIGS. 7 and 8, the circuit board 12*a* or 12'*a* is configured in such a way that it can latch positively with the rest of the module housing 9*a* or 9'*a*. The circuit board 12*a* or 12'*a* thus provides a cover function. A fixing of the functional parts within the module housing can consequently be achieved. The indicator unit 15*a*, too, is held upright in the module housing 9*a*, 9'*a* by means of corresponding positioning profiles, as may be gathered clearly from FIGS. 7 and 8. The conductive rubber 14 assumes not only the conductive connection between the indicator unit 15*a* and circuit board 12*a*, but also the fixing of the indicator unit 15*a* in the region of its underside.

Figure 9:
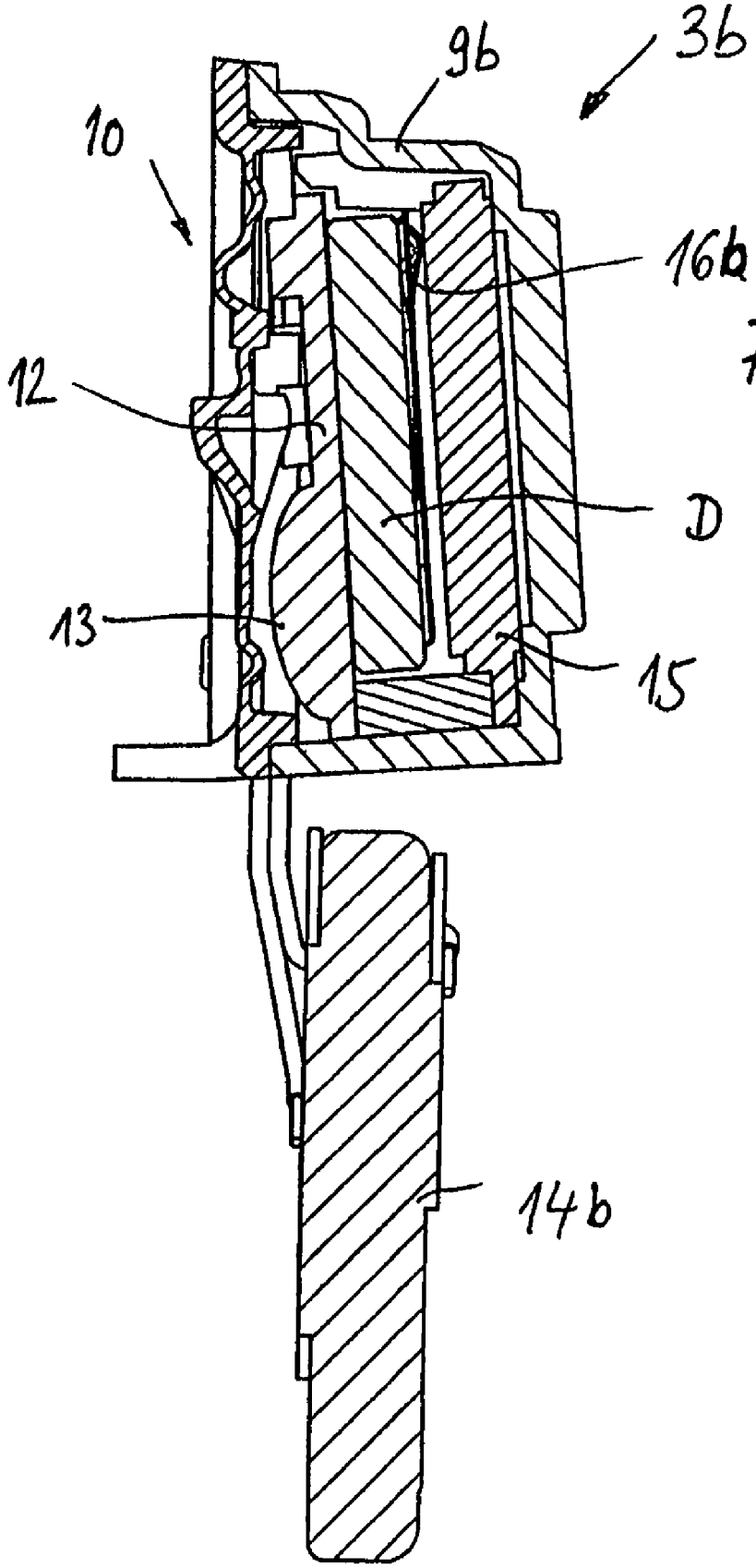
FIG. 9 shows a further electronic counting module similar to FIG. 2, but with an external current source.

The embodiment according to FIG. 9 corresponds essentially to the embodiment according to FIG. 2, and therefore reference may be made to the version according to FIG. 2 in terms of construction and functioning. The essential difference in the electronic counting module 3*b* according to FIG. 9 is that, there, an external current source 14*b* is provided, which is arranged outside the module housing 9*b* and is merely connected electrically conductively to the circuit board. In the embodiment according to FIG. 9, the component D is not an electrical functional part, such as a current source or the like, but is only provided as a space saver or filling element for the space between the circuit board 12 and the indicator unit 15. Moreover, the component D is assigned an elastic restoring element 16*b* which is designed similarly to the restoring element 16 according to FIG. 2. Reference is made to the statements regarding FIGS. 2 to 6 for further details of the counting module 3*b*.

If the stroke detection means has according to FIG. 7 two switching elements which, in particular, can detect an upper and a lower stroke position, evaluation going beyond a straightforward counting operation can be achieved here by the data processing processor by a time element, in particular a timer unit, being incorporated. In all the exemplary embodiments illustrated, stroke detection is carried out by contact, to be precise by touch-contact operations. In other embodiments, namely those not illustrated, it is possible to carry out contactless stroke detection, in particular capacitive, inductive or optical stroke or displacement detection.

Depending on the design of the data processing processor and of the indicator unit, according to further exemplary embodiments of the invention which are not illustrated, further information, such as a weak current source, a virtually empty medium store or the like, can be indicated. Alternatively or additionally, the starting phase immediately after the commissioning of the metering device, which is also designated as priming, may also be indicated. If a time element is used, a patient, to be precise an operator, can also be advised by means of a corresponding signal function that he has to take a dose of medium again.

The invention claimed is:

1. metering device for a medium, comprising:

an applicator with an applicator housing, said applicator housing having at least one application orifice for a medium discharge, a medium store, a metering pump for conveying the medium out of said medium store to the applicator, said metering pump having a movable pump portion, an electronic counting module, said electronic counting module having at least one stroke detection means operatively engaging said movable pump portion, a data processing processor for detecting and evaluating signals from said stroke detection means in response to operation of said movable pump portion, an indicator unit for indicating data produced by the data processing processor, and a current source for supplying the data processing processor with current, wherein the applicator housing has a receptions space, wherein the electronic counting module has a module housing, external dimensions of said module housing being adapted to internal dimensions of said reception space, said module housing having an inspection window behind which said indicator unit is positioned and viewed through said inspection window, wherein the reception space has a mounting and demounting orifice through which said module housing can be inserted completely into the reception space, wherein fastening means are provided to facilitate a fastening of the module housing in the reception space, and wherein the reception space additionally has an outwardly open clearance, in which the inspection window of the module housing is configured to be received when the module housing is mounted in the reception space.

2. metering device according to claim 1, wherein the module housing and the reception space are correspondingly sized with respect to one another in order to facilitate the module housing being releasably and toollessly received in the reception space.

3. metering device according to claim 2, wherein the fastening means includes operatively engageable latching profiling on the module housing and the reception space to cause the module housing to be latched in the reception space.

4. metering device according to claim 2, wherein the fastening means includes operatively engageable latching profiling on the inspection window of the module housing and on the open clearance in the reception space to cause the module housing to be latched in the reception space.

5. metering device according to claim 1, wherein the inspection window is a one-piece part of said module housing.

6. metering device according to claim 1, wherein the at least one stroke detection means is configured for digital or analog displacement detection.

7. metering device according to claim 1, wherein the data processing processor is arranged on a circuit board arranged in the module housing and configured to execute deflecting movements in at least one direction.

8. metering device according to claim 1, wherein the module housing is made of a material configured to form at least one of a liquid tight and gas tight housing.

9. metering device according to claim 8, wherein the module housing is produced from at least one of a thermoplastic and elastomeric material.

10. metering device according to claim 7, wherein the current source is a battery and is sandwiched between the indicator unit and the circuit board.

11. metering device according to claim 1, wherein the module housing has an opening that is closed by a closing cover which, in the mounted state in said reception space, opposes the movable pump portion.

12. metering device according to claim 11, wherein the closing cover is separate from the module housing and is connected to the module housing to form a liquid tight and gas tight seal therewith.

13. metering device according to claim 11, wherein the closing cover comprises at least one touch-contact boss which is configured to engage the stroke detection means and which is movable between a switching position and a position of rest, the closing cover comprising a diaphragm having thereon the touch-contact boss.

14. metering device according to claim 13, wherein the diaphragm and the touch-contact boss are of a unitary construction.

* * * * *